US011060478B2

(12) United States Patent
Wicks et al.

(10) Patent No.: US 11,060,478 B2
(45) Date of Patent: Jul. 13, 2021

(54) SYSTEM FOR AN INTEGRATED HYBRID COMPOSITE CYLINDER HEAD AND TURBINE

(71) Applicant: Ford Global Technologies, LLC, Dearborn, MI (US)

(72) Inventors: Christopher Donald Wicks, Allen Park, MI (US); Mark Michael Madin, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/427,227

(22) Filed: May 30, 2019

(65) Prior Publication Data

US 2020/0378333 A1 Dec. 3, 2020

(51) Int. Cl.

| | |
|---|---|
| ***F02F 1/18*** | (2006.01) |
| ***F02F 1/40*** | (2006.01) |
| ***F02F 11/00*** | (2006.01) |
| ***F02D 1/00*** | (2006.01) |
| ***F02B 37/00*** | (2006.01) |

(52) U.S. Cl.

CPC ..... *F02F 1/18* (2013.01); *F02B 37/00* (2013.01); *F02D 1/00* (2013.01); *F02F 1/40* (2013.01); *F02F 11/002* (2013.01); *F02F 2200/06* (2013.01)

(58) Field of Classification Search

CPC .... F02F 1/18; F02F 1/40; F02F 11/002; F02F 2200/06; F02D 1/00

See application file for complete search history.

(56) References Cited

U.S. PATENT DOCUMENTS

| | | | | |
|---|---|---|---|---|
| 4,003,422 | A | 1/1977 | Schramm et al. | |
| 4,087,199 | A | 5/1978 | Hemsworth et al. | |
| 4,341,826 | A | 7/1982 | Prewo et al. | |
| 4,373,326 | A | 2/1983 | Smale | |
| 5,083,537 | A | 1/1992 | Onofrio et al. | |
| 5,384,200 | A | 1/1995 | Giles et al. | |
| 5,657,729 | A | 8/1997 | Atmur et al. | |
| 5,730,096 | A | 3/1998 | Atmur et al. | |
| 5,769,046 | A | 6/1998 | Ransone | |
| 5,908,016 | A | 6/1999 | Northam et al. | |
| 6,050,234 | A | 4/2000 | Hannoosh | |
| 6,197,424 | B1 * | 3/2001 | Morrison | F01D 11/12 428/402 |
| 6,581,381 | B2 | 6/2003 | Kim | |
| 8,777,582 | B2 | 7/2014 | Darkins, Jr. et al. | |
| 9,341,136 | B2 | 5/2016 | Williams et al. | |
| 9,416,749 | B2 | 8/2016 | Maki et al. | |

(Continued)

FOREIGN PATENT DOCUMENTS

| | | | |
|---|---|---|---|
| EP | 2143926 | A1 | 1/2010 |
| JP | 2018053840 | * | 4/2018 |

OTHER PUBLICATIONS

Wicks, C., "Integrated Cylinder Head Fluid Injection Apparatus," U.S. Appl. No. 16/031,791, filed Jul. 10, 2018, 41 pages.

*Primary Examiner* — Syed O Hasan

(74) *Attorney, Agent, or Firm* — Geoffrey Brumbaugh; McCoy Russell LLP

(57) ABSTRACT

Methods and systems are provided for a turbine integrally formed with a cylinder head. In one example, a system includes a cylinder head and a turbine shaped from a single, continuous piece of metal.

19 Claims, 6 Drawing Sheets

(56) References Cited

U.S. PATENT DOCUMENTS

| | | | | |
|---|---|---|---|---|
| 2007/0163250 | A1 | 7/2007 | Sane et al. | |
| 2013/0149126 | A1* | 6/2013 | Herrera Celaya | F02B 39/005 415/200 |
| 2013/0247565 | A1* | 9/2013 | Marques | F02F 1/243 60/605.1 |
| 2016/0230696 | A1 | 8/2016 | Williams et al. | |
| 2018/0120246 | A1* | 5/2018 | Baucke | G01R 15/144 |

* cited by examiner

SYSTEM FOR AN INTEGRATED HYBRID COMPOSITE CYLINDER HEAD AND TURBINE

FIELD

The present description relates generally to an integrated cylinder head and turbine with a composite coating extending from the cylinder head to the turbine.

BACKGROUND/SUMMARY

Cylinder heads may comprise materials such as cast iron and/or aluminum. Metal cylinder heads, such as cast iron, may be heavy and exhibit low thermal conductivity. While aluminum cylinder heads may be lighter, they are more expensive to make than cast iron heads. Additionally, aluminum cylinder heads may exhibit inadequate corrosion resistance and undesired thermal expansion during some conditions.

One example approach is shown by Williams et al. in U.S. 2016/0230696. Therein, a hybrid composite coating is arranged in portions of a cylinder head that may be contacted by exhaust gas. The hybrid composite coating may at least partially block heat transfer between exhaust gases and a material shaping the cylinder head.

However, the inventors have identified some limitations with the approach described above. For example, as engine packaging arrangements become more compact, exhaust gas temperatures at a turbine coupled to a cylinder head with the hybrid composite coating are elevated, thereby increasing cooling demands. The increased cooling demands may result in coolant being diverted from other powertrain components also demanding cooling, which may decrease engine performance. Furthermore, control schemes for coolant flow and coolant passages positioned in the turbine case may increase a cost of manufacture.

Previous examples teaching integration of the cylinder head and the turbine comprise coolant passages in the turbine case to advantageously receive coolant from the cylinder head. One example approach is shown by Kuhlbach in EP 2,143,926. Therein, a turbine is combined with a cylinder head and a coolant passage is formed in a turbine casing to provide temperature control. However, these arrangements for an integrated turbine combined with the hybrid composite coating would need new cooling system architectures and schemes, which may be expensive and may increase a packaging size of an engine. Furthermore, a material of the turbine casing is heavy and expensive, and difficult to integrate with the cylinder head.

In one example, the issues described above may be addressed by a system comprising a turbine integrally shaped with a cylinder head from a single-piece of metal, wherein the turbine is free of coolant passages and a gasket. In this way, a manufacturing cost of the cylinder head and the turbine may be reduced.

As one example, the cylinder head and the turbine comprise a coating that at least partially blocks contact between the single-piece of metal and exhaust gas. By doing this, temperature control of the cylinder head and the turbine may be achieved without coolant. As such, the single-piece of metal may be free of coolant passages and sealing materials associated with coolant systems. In this way, a manufacture and assembly of the cylinder head integrally formed with the turbine may be less complex while being more compact than previous examples of engines with integrated turbines.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-6 are shown approximately to scale, however, other relative dimensions may be used without departing from the scope of the present disclosure.

DETAILED DESCRIPTION

Figure 1:
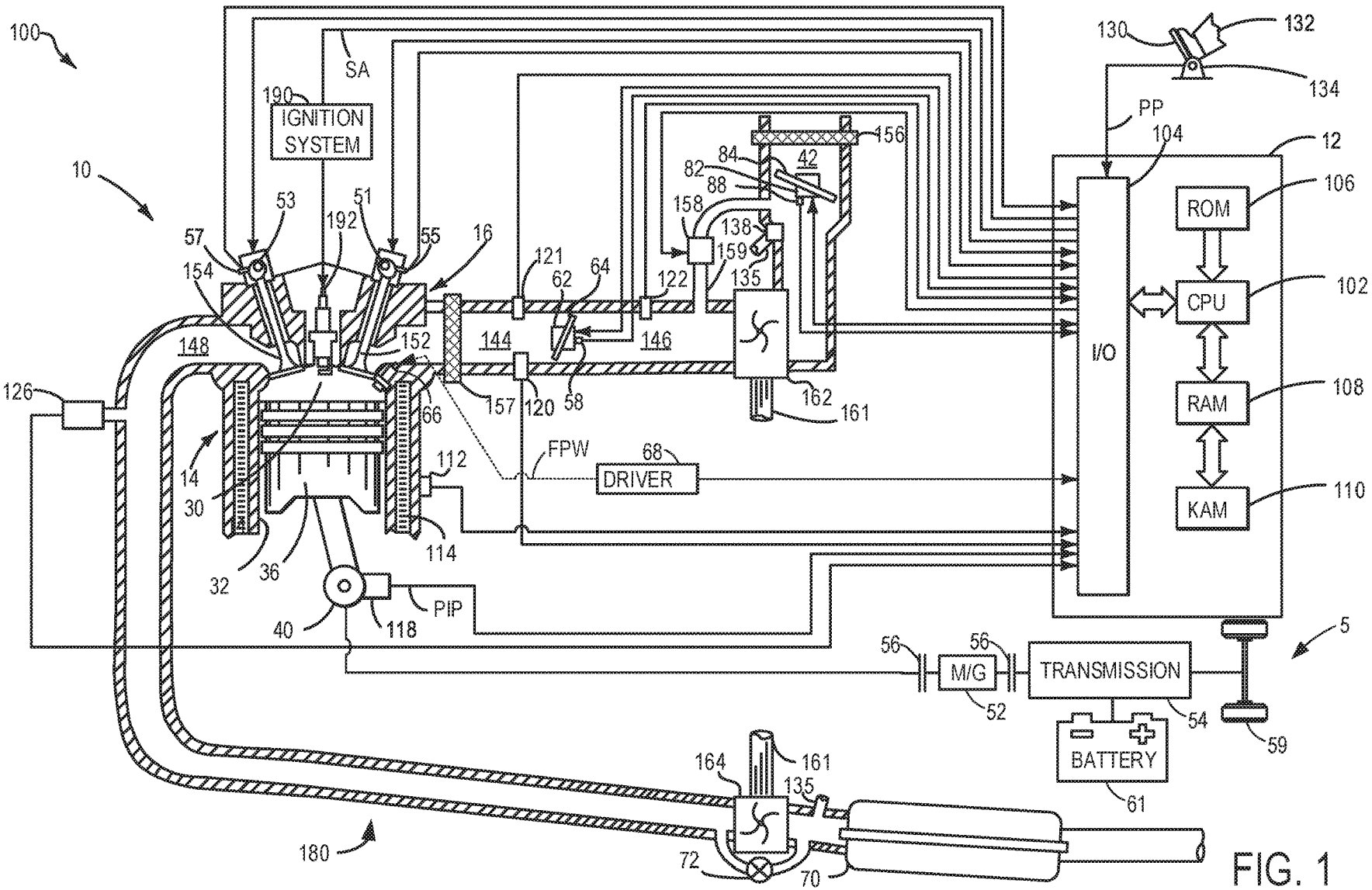
FIG. 1 illustrates a schematic of an engine included in a hybrid vehicle.

The following description relates to systems and methods for shaping a turbine and a cylinder head via a single, continuous piece. A schematic of an engine incorporated into a hybrid vehicle which may take advantage of the integration of the cylinder head and the turbine is shown in FIG. 1. FIGS. 2, 3, 4, 5, and 6 illustrate different perspective views of the cylinder head integrally formed with the turbine.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressure can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70. In some examples, emission control device 70 may be a close-coupled emission control device, wherein the emission control device 70 is close-coupled relative to the engine 10. In one example, close-coupling of the emission control device 70 to the engine 10 may include where the turbine 164 is integrally formed with the cylinder head 16 as a single-piece, and where an outlet of the turbine 164 opens directly into the emission control device 70 with no components intervening therebetween.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 59. Electric machine 52 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, adjusting operation of the electric machine 52 may occur based on feedback from ECT sensor 112. As another example, the controller may receive feedback regarding one or more combustion conditions and actuate one or more valves of a fluid injection arrangement in response to the one or more conditions. The valves and fluid injection arrangement are described in greater detail herein.

Turning now to FIGS. 2-6, they show various views 200-600 of a cylinder head 210 integrally formed with a turbine 220. FIGS. 2 through 6 may be described in tandem herein with similar components being similarly numbered in the figures. Cylinder head 210 may be used similarly to cylinder head 16 of FIG. 1 and turbine 220 may be used similarly to turbine 164 of FIG. 1. Each of the figures comprises an axis system 290, comprising three axes, namely an x-axis parallel to a horizontal direction, a y-axis parallel to a vertical direction, and a z-axis perpendicular to each of the x- and y-axes.

The cylinder head 210 and the turbine 220 may comprise a metal structure 202 and a polymer composite structure 204. The metal structure 202 may be a single piece, shaping each of the cylinder head 210 and the turbine 220. In one example, the metal structure 202 is continuous, with no intervening components interrupting a profile of the metal structure 202 as it extends from the cylinder head 210 to the turbine 220.

The metal structure 202 may contain one or more components of the cylinder head 210 including but not limited to one or more valve stem guides, an exhaust face, one or more intake and exhaust valve spring seats, a fire deck, one or more domes of one or more combustion chambers, one or more head bolt columns, or a combination thereof. The fire deck may include one or more intake and/or exhaust ports, which may be passages cast into a portion of the metal structure 202 corresponding to the cylinder head 210 leading to the manifolds of the respective valves. In some aspects, the cylinder head 210 may include one or more supporting elements 295 extending from the cylinder head 210 towards the turbine 220. The cylinder head 210 may further include one or more ribs 298 supporting the one or more supporting elements 295.

The metal structure 202 may comprise one or more of aluminum, texturized aluminum, steel, or another metal, depending on the specific engine application. The metal structure 202 may be made from one or more alloys. For example, the metal structure 202 may be made from an aluminum alloy comprising copper, silicon, manganese, magnesium, the like, or a combination thereof. An addition of silicon and/or copper reduces thermal expansion and contraction, durability, and castability of the metal structure 202. An addition of copper may promote age-hardening. An addition of manganese and/or magnesium improves strength of the alloy. Because the metal structure 202 forms a portion of a combustion chamber (e.g., combustion chamber 30 of FIG. 1), the material of the metal structure 202 may be able to withstand increases in temperature and pressure during the combustion process. The type of material used for the metal structure 202 may be adjusted depending on the needs of a specific application such as desired performance, peak pressure, duty cycle, the like, or a combination thereof. In one example, the metal structure 202 comprises aluminum or an alloy thereof. Additionally or alternatively, the metal structure may be a stainless steel.

As described above, the previous examples fail to provide a cylinder head and turbine integrally formed as a single-piece. Furthermore, aluminum or an alloy thereof, which is used to form the single-piece cylinder head and turbine in the present disclosure, comprises a relatively low temperature rating of about 250° C. While this is relatively low for many engine applications, and especially so for spark-ignited engines, the aluminum used in the present disclosure comprises a light-weight and is relatively malleable to more easily manufacture the cylinder head and turbine as a single metal piece compared to other materials like stainless steel, cast iron, and the like. The polymer composite structure 204 may shield the metal structure 202 (e.g., aluminum) from the high engine and exhaust temperatures so that the metal structure may not degrade despite high-temperature exhaust gases flowing through passages formed therein.

Figure 2:
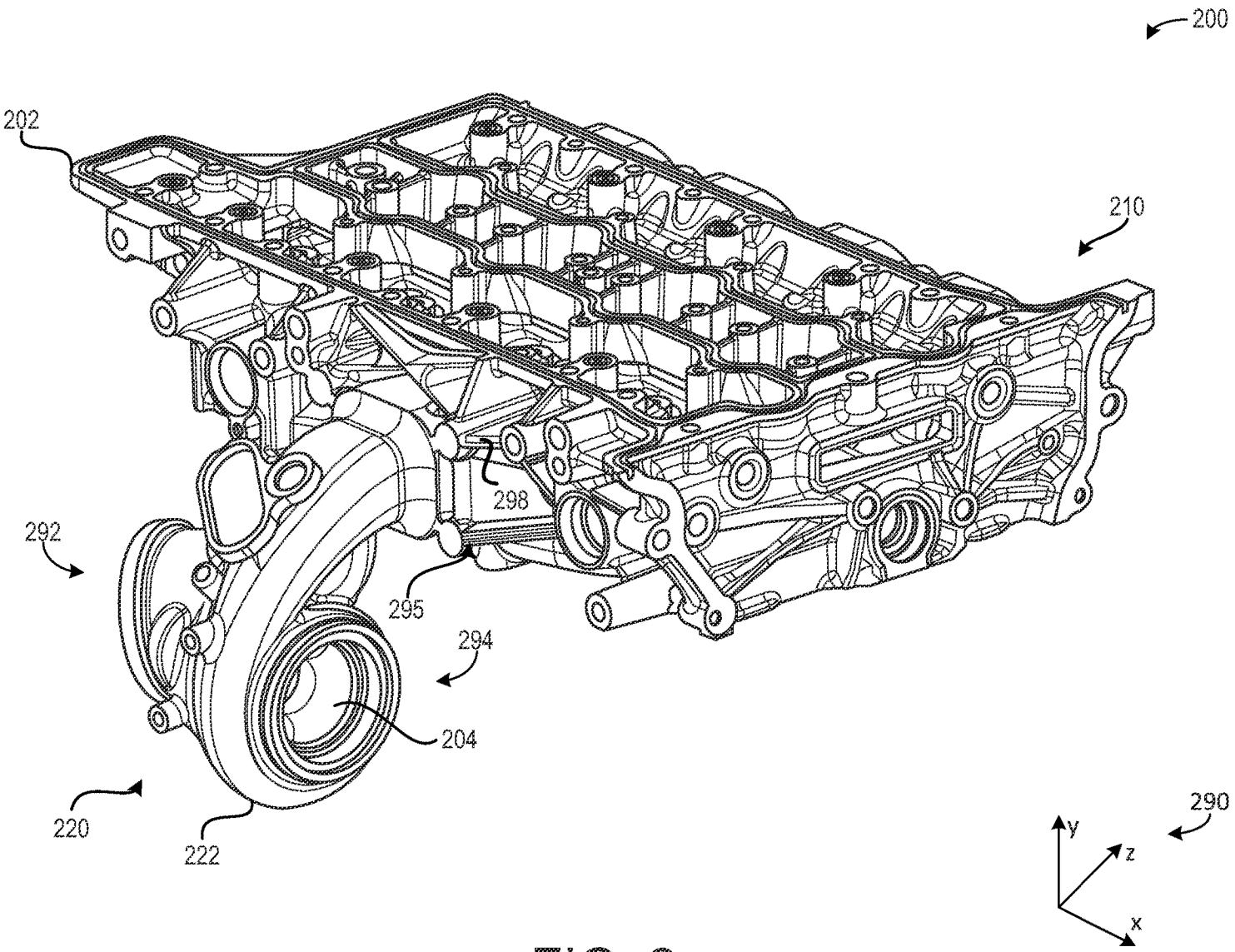
FIG. 2 illustrates a perspective view of a cylinder head integrally formed with a turbine from an outlet side of the turbine.
Figure 3:
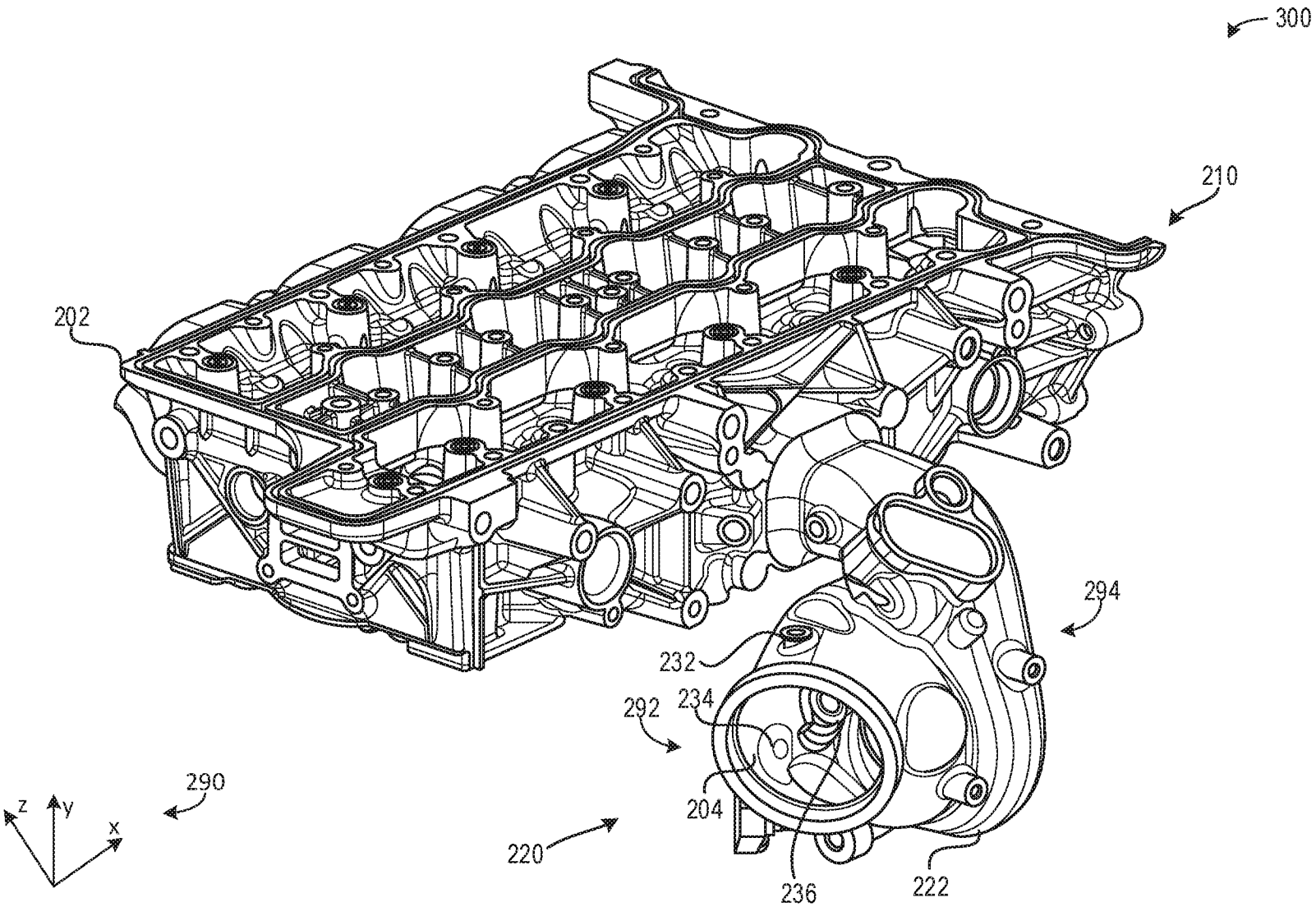
FIG. 3 illustrates a perspective view of the cylinder head integrally formed with the turbine from a bearing side of the turbine.

In the embodiments 200 and 300 of FIGS. 2 and 3, respectively, a portion of the polymer composite structure 204 in the cylinder head 210 is occluded by the metal structure 202. However, a portion of the polymer composite structure in the turbine 220 is exposed. The embodiment 200 reveals a portion of the polymer composite structure 204 near an exhaust outlet side 292 of the turbine 220, wherein exhaust gases leave the turbine 220 from the exhaust outlet side 292 to flow to a remainder of an exhaust system. The embodiment 300 reveals a portion of the polymer composite structure 204 near a compressor side 294 of the turbine.

In one example, an entire interior of the turbine 220 is coated with the polymer composite structure 204. In other examples, portions of the interior of the turbine 220 may be uncoated, so that heat may transfer from exhaust gases to the metal structure 202 advantageously. In some examples, the turbine 220 may comprise uncoated portions near the compressor side 294 such that the metal structure 202 near the compressor side 294 may heat lubricant in a bearing housing. In one example, the turbine 220 is coated with the polymer composite structure 204 up to a compressor. Thus, the terminal end of the turbine 220 at the compressor side 294 may be an end of a bearing housing, wherein the end of the bearing housing is in contact with a compressor housing. The bearing housing may comprise lubricant passages arranged therein via a separate structure arranged interior to the metal structure 202 and the polymer composite structure 204. In this way, heat retention is in the bearing housing is increased, which may increase a lubricant lubricity.

The polymer composite structure 204 may comprise a composite material and may at least partially surround and/or cover portions of the metal structure 210 forming the cylinder head 210 and the turbine 220. The polymer composite structure 204 may include reinforced polymer material. The polymer composite structure 204 may include a thermoplastic material. The polymer composite structure 204 may include a thermoset resin. The thermoset resin may include a polyester resin, an epoxy resin, a phenolic resin, a polyurethane, a polyimide, a silicone, or other type of resins, and combination thereof. The polymer composite structure 204 may be reinforced with a fibrous material. The polymer composite structure 204 may include fiber-reinforced polymers. For example, the polymer composite structure 204 may be reinforced with carbon fiber, aramid fiber, glass, basalt, the like, or a combination thereof. The polymer composite structure 204 may be reinforced with lignocellulosic fibers such as cotton, wool, flax, jute, coconut, hemp, straw, grass fiber, and other fibers available directly from natural sources, as well as chemically modified natural fibers, for example chemically modified cellulose fibers, cotton fibers, etc. Suitable natural fibers also include abaca, cantala, caroa, henequen, istle, Mauritius, phormium, bowstring, sisal, kenaf, ramie, roselle, sunn, cadillo, kapok, broom root, coir, crin vegetal, and piassaua. These lists of natural fibers are illustrative and not limiting. Examples of chemically modified fibers also include azlon (regenerated natural proteins), regenerated cellulose products including cellulose xanthate (rayon), cellulose acetate, cellulose triacetate, cellulose nitrate, alginate fibers, casein-based fibers, and the like.

In one or more embodiments, the polymer composite structure 204 includes a thermoset resin reinforced with carbon fibers to increase stiffness, provide the desired weight reduction, excellent fatigue resistance, and chemical resistance. Carbon fibers are also suitable due to their high strength-to-weight and stiffness-to-weight ratio.

The polymer composite structure 204 may include a plurality of components of the cylinder head 210. In one or more non-limiting embodiments, the polymer composite structure 204 may include one or more water jacket core supports, one or more intake valve spring pockets, one or more spark plug and direct injection pockets, one or more fuel pump pedestal pockets 4, one or more oil feeds to the cam, one or more intake and exhaust oil feeds for a hydraulic lash adjuster, an intake mounting port, one or more side direct injection mounting ports, one or more intake mounting ports, a front cover seal rail, a cam cover mounting rail, and/or one or more cam carrier mounting ports. It is contemplated that other parts of a cylinder head may be a part of the polymer composite structure 204. For example, intake manifolds or a base head (not depicted) may be included in the polymer composite structure 204.

To enhance an engagement and/or coupling between the polymer composite structure 204 and the metal structure 202, a surface area of the metal structure 202 may be increased in some areas of the metal structure to block disengagement and/or decoupling between the metal structure 202 and the polymer composite structure 204. The surface area may be increased by adding texture to at least some areas of the metal structure 202. This can be done by a variety of methods, for example by roughening, serrating, micro-serrating, abrasive cutting, blasting, honing, electrical discharge machining, milling, etching, chemical milling, laser texturing, or by another process, or a combination thereof.

In one example, the metal structure 202 is an aluminum alloy and the polymer composite structure 204 is ceramic or a composite thereof. The metal structure 202 may be more thermally conductive than the polymer composite structure 204. As such, the polymer composite structure 204 may be strategically used to coat portions of the metal structure 202 to block thermal communication of the metal structure 202 with a high temperature substance, such as exhaust gas. By arranging the polymer composite structure 204 between the metal structure 202 and passages formed therein shaped to flow exhaust gas, heat transfer from the exhaust gas to surfaces of the metal structure may be decreased and/or blocked, which may decrease a cooling demand.

For example, a plurality of passages may be formed in the portion of the metal structure 202 of the cylinder head 210 for directing exhaust gases from a combustion chamber to an exhaust manifold fluidly coupled to the exhaust passage. Surfaces of the plurality of passages may be covered and/or coated with the polymer composite structure 204, thereby blocking contact between the metal structure 202 and exhaust gas. The polymer composite structure 204 may be thermally isolating such that heat may be blocked from passing through the polymer composite structure 204 to the metal structure 202. In this way, a complexity of the cylinder head 210 may be reduced since fewer cooling passages are desired therein.

In some examples, additionally or alternatively, portions of the metal structure 202 in the cylinder head 210 may be exposed such that exhaust gas may contact the exposed portions of the metal structure 202. In this way, the exposed portions of the metal structure may be hotter than unexposed portions. Coolant passages may be in contact with the exposed portions to regulate a temperature of the exposed portions. Regulating the temperature of the exposed portions includes cooling the exposed portions, wherein during some engine operating conditions, such as during a cold-start, regulating the temperature may provide a symbiotic effect, wherein the metal structure 202 is cooled and the coolant is heated, which may decrease a cold-start time.

As described above, the turbine 220 is integrally formed with the cylinder head 210, wherein the metal structure 202 shaping each of the cylinder head 210 and the turbine 220 is a single, continuous piece. In this way, the turbine 220 is held in place adjacent to the cylinder head 210 without fasteners, adhesives, welds, fusions, and other coupling materials. The cylinder head 210 and the turbine 220 may be manufactured via an additive manufacturing process (e.g., 3D printing). As shown, the turbine 220 comprises a wastegate orifice 272, one or more sensor ports 232, a bolt depression 234, and a bearing support 236.

In one example, the metal structure 202 is inserted in a dye of a molding machine. The metal structure 202 may be tempered. The dye is closed. The composite material of the polymer composite structure is supplied into the dye. The polymer composite structure 204 may form by molding during which the composite material cures. The composite material may be molded over the metal structure placed in the dye. The composite material may be molded by injection molding, compression molding, spin casting, or another molding method. The cure may be induced by heat of about 200° C. or more, by a chemical reaction, irradiation, or a combination thereof. The curing process transforms the thermosetting plastic to a hardened thermoset resin which has taken its final shape due to a cross-linking process. One or more catalysts and/or energy can be added during the reaction to cause the molecular chains to react at chemically active sites and link into a rigid 3-D structure which cannot be reheated to change its shape. After curing, the polymer composite structure 204 may be ready for high-temperature applications.

The metal structure 202 may form one or more of the turbine case 222 and a turbine nozzle. The metal structure 202 at the turbine 220 may comprise one or more openings for coupling the turbine 220 to a bearing house of a turbocharger. The openings may be shaped to receive a bolt or other fastener, thereby physically coupling the bearing house and rest of the turbocharger to the turbine 220. For example, the bolt depression 234 may allow for a bolt of a wastegate (e.g., wastegate 72 of FIG. 1) to extend further where it would otherwise contact the portion of the metal structure 202 corresponding to the turbine case 222.

The polymer composite structure 204 may extend into the turbine 220, wherein the polymer composite structure 204 may cover and/or coat various surfaces of the turbine 220 shaped by the metal structure 202 to direct exhaust gases to a turbine blade and to a remainder of an exhaust passage downstream of the turbine 220. For example, interior exhaust gas surfaces of the turbine 220 may be coated with the polymer composite structure 204, which may include an exhaust gas duct, the turbine nozzle, the turbine case, and the like.

In some examples, the turbine blade may also be coated with the polymer composite material 204. However, the section of the polymer composite material 204 coating the turbine blade may be separated from the polymer composite material 204 coating interior surfaces of the turbine 220 and the cylinder head 210.

In the examples of FIGS. 2 through 6, the polymer composite structure 204 is coated on all interior portions of the turbine 220 illustrated. As such, the polymer composite coating may extend to the extreme end of the outlet side 292 and to the extreme end of the compressor side 294. As described above, the extreme end of the compressor side 294 may correspond to a location of the compressor (e.g., compressor 162 of FIG. 1). As such, the metal structure 202 may also form a bearing housing of the turbine 220, wherein lubricant passages of the bearing housing are formed radially interior to the metal structure 202 and the polymer composite structure 204.

The outlet side 292 may abut with a catalyst, such as a close-coupled catalyst. By coating the metal structure 202 with the polymer composite structure 204 up to an opening of the catalyst, a light-off temperature of the catalyst may be reached more quickly than in previous examples where heat loss occurs through an exhaust pipe.

Figure 4:
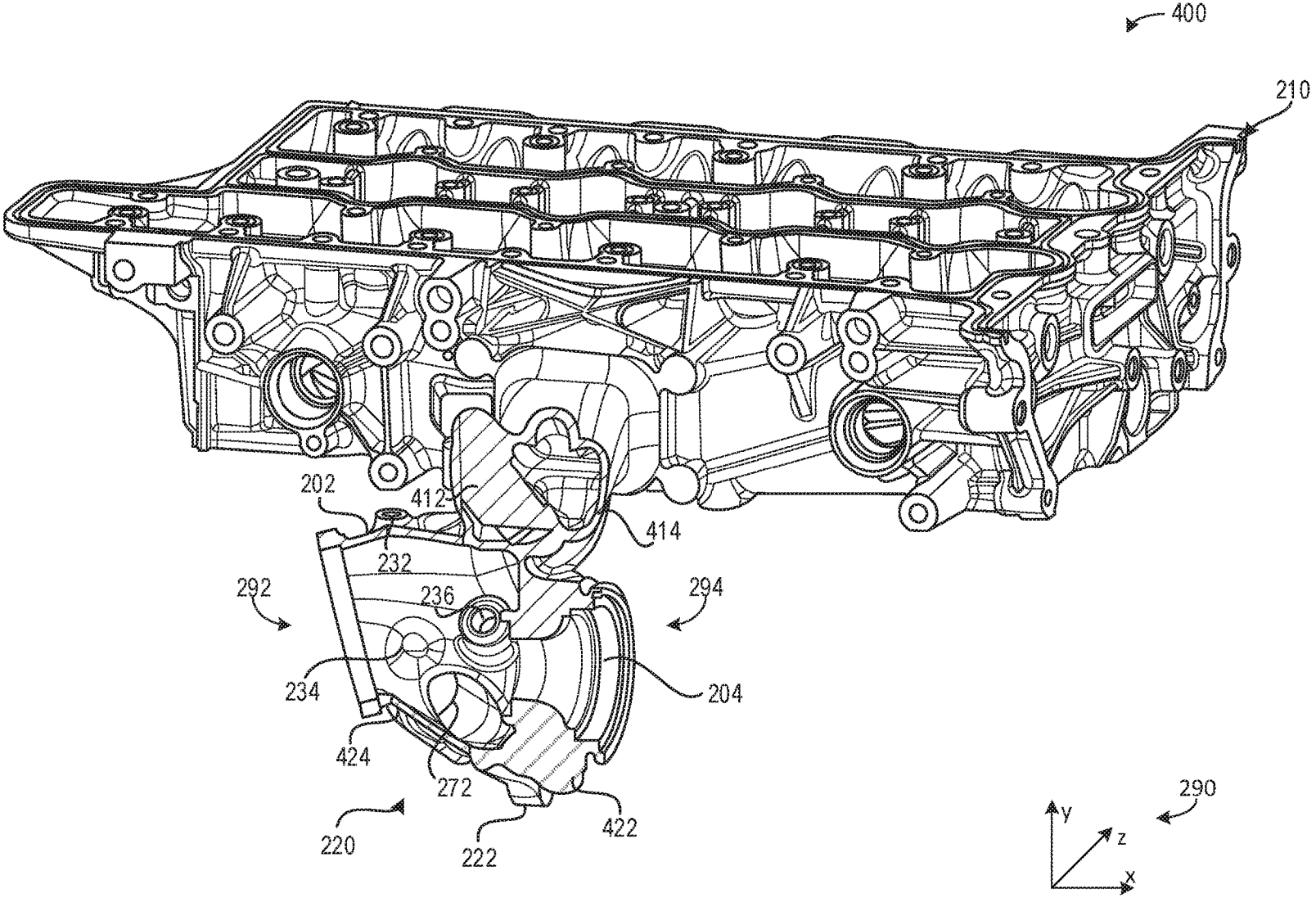
FIG. 4 illustrates a cross-section of the turbine.
Figure 5:
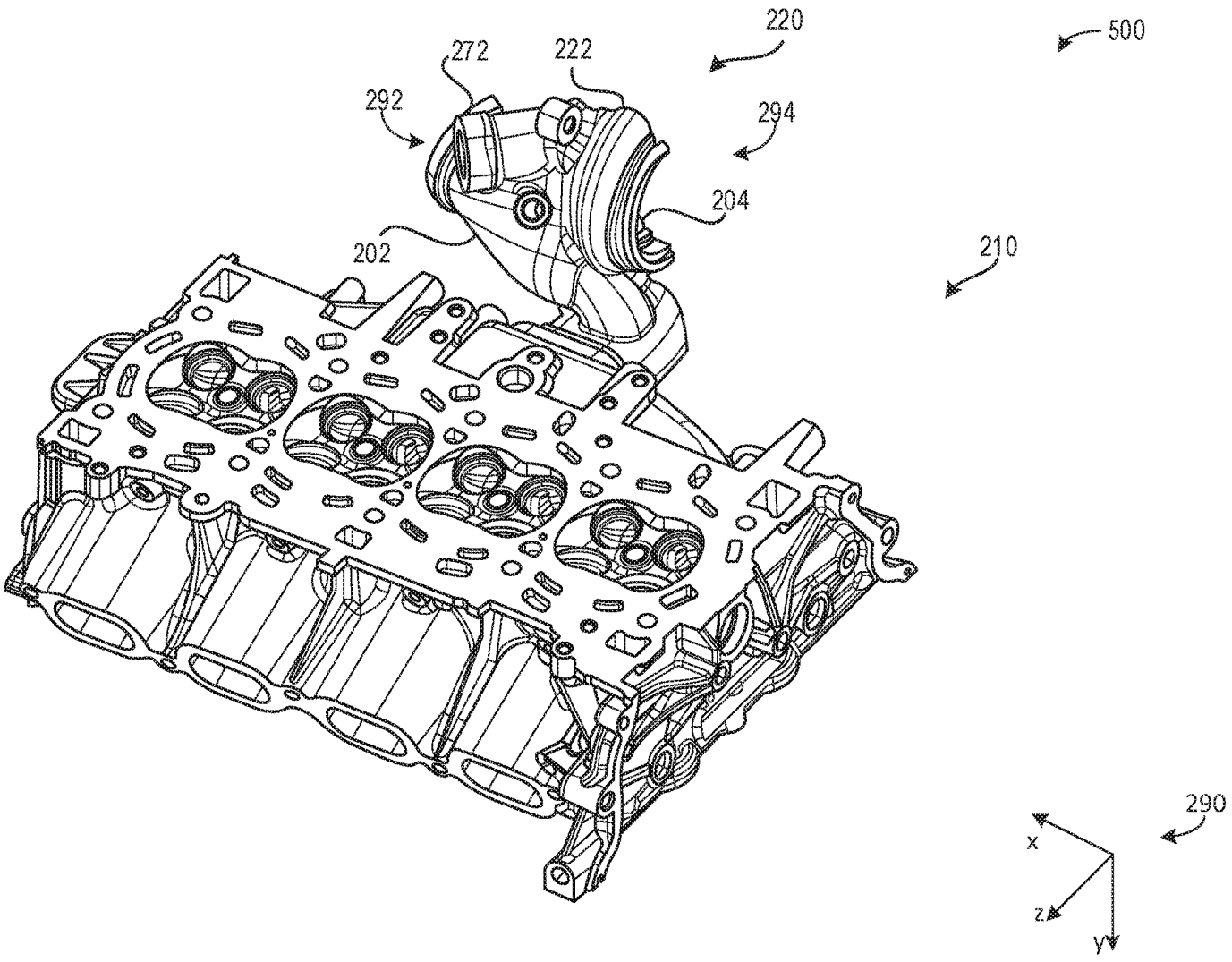
FIG. 5 illustrates a perspective view the cylinder head integrally formed with the turbine from an inlet side of the cylinder head.
Figure 6:
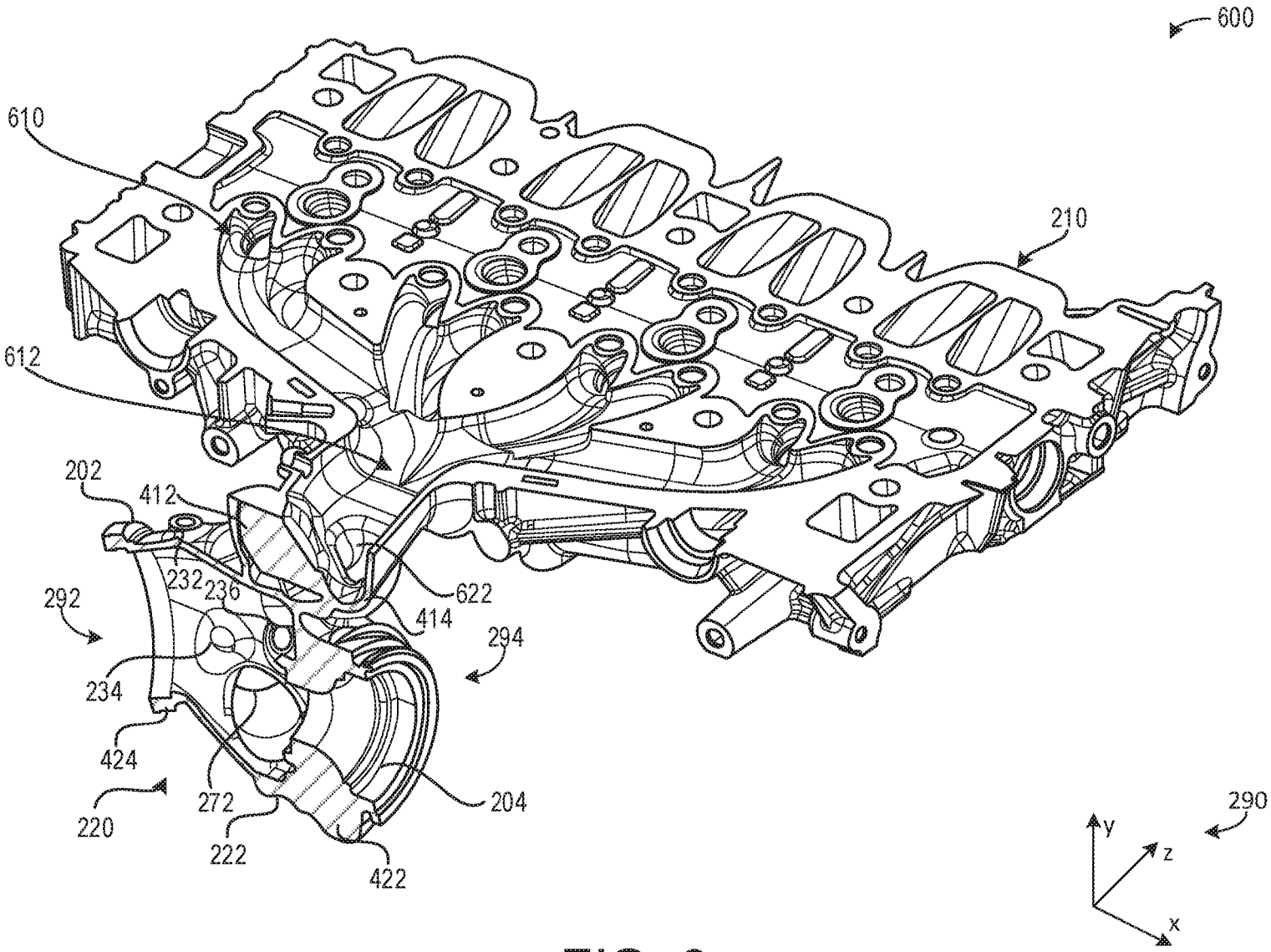
FIG. 6 illustrates a cross-section of the turbine and the cylinder head.

Embodiment 400 of FIG. 4 and embodiment 600 of FIG. 6 illustrate cross-sections of the turbine 220, thereby exposing an interior of the turbine 220. The interior of the turbine 220 is coated with the polymer composite material 204. FIG. 5 shows a perspective view 500 of the cylinder head 210 and the turbine 220 from an inlet side of the cylinder head 210.

Turning now to FIG. 6, the embodiment 600 further shows interior portions of the cylinder head 210 as well as the turbine 220. The cylinder head 210 is shaped to be a head for a four cylinder in-line engine spark-ignited engine with eight valves. However, it will be appreciated that the cylinder head 210 may be shaped to accommodate other engine arrangements for a spark-ignited or spark-less engine comprising various valve and cylinder configurations.

The cylinder head 210 is shaped to allow two or more exhaust passages 610 to extend from respective cylinders, where the two or more exhaust passages 610 merge to form a single exhaust passage 612, which may be similar to exhaust passage 148 of FIG. 1. In some examples, additionally or alternatively, the turbine 220 may comprise multiple ducts, each duct corresponding to an exhaust passage leading from the cylinder head 210 to the turbine 220. As such, more than one exhaust gas passage may fluidly couple the cylinder head 210 to the turbine 220 in some embodiments.

The single exhaust passage 612 may open into an inlet 622 of the turbine 220, wherein a flow duct may direct exhaust gases from the inlet 622 to a rotor and/or a turbine blade of the turbine. The exhaust gas may exit the turbine 220 to an exhaust system to be treated and expelled to an ambient atmosphere. The two or more exhaust passages 610, the single exhaust passage 612, the inlet 622, and other portions of the turbine 220 that may be contacted by exhaust gases may be coated with the polymer composite structure 204. By doing this, a cooling demand is reduced to an extent where coolant is not desired.

More specifically, the single exhaust passage 612 extends outwardly from the cylinder head 210 along the z-axis before turning in a downward direction along the y-axis toward the turbine 220. As the turbine 220, the single exhaust passage 612 may transition to a volute of the turbine 220 shaped to feed exhaust gases to a turbine blade. Portion 412 of the metal structure 202 arranged on the outlet side 292, where the exhaust passage 612 interfaces with the turbine 220, is thicker than portion 414 arranged adjacent to the compressor side 294. A fillet of the portion 414 formed at the interface and/or transition between the exhaust passage 612 of the cylinder head 210 and the turbine 220 may be relatively small compared to a fillet formed in previous examples where a flange or other coupling element is used or a material thicker than aluminum with a higher thermal rating is used. In one example, the fillet does not extend further along the x-axis than the single exhaust passage 612. That is to say, the metal structure 202 shaping the fillet comprises a width equal to or less than a width of the metal structure 202 shaping the single exhaust passage 612.

A portion 422 of the turbine 220 shaping the compressor side 294, arranged below the single exhaust passage 612, may be thicker than a portion 424 near the exhaust outlet side 292. The metal structure 202 may be thicker in portions of the turbine case 222 to provide additional support for the bearing housing. Additionally or alternatively, the portion 422 may be shaped to receive one or more fasteners from a compressor housing to physically couple the compressor housing to the turbine 220. In some examples, additionally or alternatively, the compressor housing may be welded, glues, of fused to the compressor side 294 of the turbine 220. In one example, the turbine housing may provide a mount for the compressor case to complete the turbocharger. In one example, this may include a marmon flange, which is cast as part of the metal structure 202. Additionally or alternatively, the marmon flange may be coated with the polymer composite structure 204.

In previous examples, such as the previous example described above, turbines integrated with the cylinder head need coolant passages formed in the turbine case to provide a desired amount of temperature control due to the relatively high temperatures of the exhaust gas. To block coolant from entering exhaust passages of the turbine and cylinder head and/or exhaust gas from leaking from the interface, gaskets and/or other sealing elements may be arranged between the coupling of the turbine and the cylinder head. A flange or other structural element may be used to increase a coupling strength between the turbine and the cylinder head.

As shown in the FIGS. 2-6 and described above, the turbine 220 and the cylinder head 210 are shaped via a single-piece of metal. This may afford the cylinder head 210 and the turbine 220 to omit flange of the cylinder head and the turbine. Furthermore, fasteners used to press the flanges against one another may also be omitted.

In this way, a complexity of a cylinder head and a turbine may be reduced by omitting coolant passages therefrom. The polymer composite structure may be coated onto surfaces of the cylinder head and the turbine that may be exposed to exhaust gases. The technical effect of coating the surfaces of the cylinder head and the turbine is to decrease heat transfer from the exhaust gas to a single metal structure shaping the turbine and the cylinder head. By doing this, a packaging size of the cylinder head and the turbine may be reduced and a number of parts used to couple the cylinder head and the turbine may be decreased, thereby decreasing a manufacturing cost.

An embodiment of a system comprises a cylinder head and a turbine shaped via a single-piece of a metal.

A first example of the system, further includes where the metal is continuous and uninterrupted.

A second example of the system, optionally including the first example, further includes where a polymer composite structure coated onto portions of the metal exposed to exhaust gases.

A third example of the system, optionally including any of the previous examples, further includes where an interface between the cylinder head and the turbine is free of a gasket and a flange.

A fourth example of the system, optionally including any of the previous examples, further includes where the turbine is free of coolant passages.

A fifth example of the system, optionally including any of the previous examples, further includes where the metal is an aluminum alloy.

A sixth example of the system, optionally including any of the previous examples, further includes where there are no additional components intervening between the turbine and the cylinder head.

A seventh example of the system, optionally including any of the previous examples, further includes where two or more exhaust passages of the cylinder head merging into a single exhaust passage shaped to flow exhaust gas to the turbine, wherein the two or more exhaust passages and the single exhaust passage are coated with a polymer composite structure.

An eighth example of the system, optionally including any of the previous examples, further includes where the polymer composite structure extends from the single exhaust passage to an interior of the turbine, wherein the polymer composite structure coats interior surfaces of the turbine including an interior surface of a turbine case, a turbine nozzle, and a turbine exhaust gas duct.

An embodiment of a turbocharged engine comprises a turbine integrally formed with a cylinder head, wherein a metal structure shaping the cylinder head continuously extends to shape a turbine case, wherein an interface between the turbine and the cylinder head is free of a gasket and a flange.

A first example of the turbocharged engine further comprises where the turbine is physically coupled to the cylinder head without fasteners, welds, fusions, and adhesives.

A second example of the turbocharged engine, optionally including the first example, further comprises where the turbine case is free of coolant passages, and where the metal structure extends to a close-coupled emission control device, wherein there are no intervening components arranged between the turbine case and the close-coupled emission control device.

A third example of the turbocharged engine, optionally including any of the previous examples, further comprises where the turbine case extends from a bearing housing to an exhaust outlet of the turbine.

A fourth example of the turbocharged engine, optionally including any of the previous examples, further comprises where the metal structure is aluminum or an aluminum alloy comprising one or more of copper, silicon, manganese, and magnesium.

A fifth example of the turbocharged engine, optionally including any of the previous examples, further comprises where a polymer composite coating surfaces of the metal structure shaped to flow exhaust gases in the cylinder head and the turbine.

An embodiment of a system comprises a continuous metal structure shaped as a single-piece free of interruptions in its contour, the continuous metal structure shaping a turbine case integrally formed with a cylinder head, wherein the cylinder head comprises a plurality of exhaust passages merging to form a single exhaust passage that turns in a downward direction into the turbine case.

A first example of the system, further comprises where a width of an interface where the single exhaust passage meets the turbine case is equal to or less than a width of the single exhaust passage.

A second example of the system, optionally comprising the first example, further comprises where the turbine case is free of passages for flowing liquids and gases other than an exhaust gas inlet and an exhaust gas outlet.

A third example of the system, optionally including any of the previous examples, further comprises where the turbine case comprises cut-outs for a wastegate and an exhaust gas sensor.

A fourth example of the system, optionally including any of the previous examples, further comprises where the plurality of exhaust passages, the single exhaust passage, an exhaust gas inlet of the turbine, a volute of the turbine, and an exhaust gas outlet of the turbine are coated with a polymer composite material configured to block heat transfer between exhaust gas and the continuous metal structure.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

a cylinder head and a turbine integrally shaped via a single-piece of a metal, wherein an interface between the integrally formed cylinder head and turbine comprises a plurality of supporting elements supported by ribs that extend from the cylinder head toward the turbine, wherein the interface between the cylinder head and the turbine is free of a gasket and a flange.

2. The system of claim 1, wherein the metal is continuous and uninterrupted.

3. The system of claim 1, further comprising a polymer composite structure coated onto portions of the metal exposed to exhaust gases.

4. The system of claim 1, wherein the turbine is free of coolant passages.

5. The system of claim 1, wherein the metal is an aluminum alloy.

6. The system of claim 1, wherein there are no additional components intervening between the turbine and the cylinder head.

7. The system of claim 1, further comprising two or more exhaust passages of the cylinder head merging into a single exhaust passage extending outwardly from the cylinder head along a plane of the cylinder head and turning downward toward the turbine, wherein the single exhaust passage is shaped to flow exhaust gas to the turbine and the two or more exhaust passages and the single exhaust passage are coated with a polymer composite structure.

8. The system of claim 7, wherein the polymer composite structure extends from the single exhaust passage to an interior of the turbine, wherein the polymer composite structure coats interior surfaces of the turbine including an interior surface of a turbine case, a turbine nozzle, and a turbine exhaust gas duct.

9. A turbocharged engine comprising:

a turbine integrally formed with a cylinder head, wherein a metal structure shaping the cylinder head continuously extends to shape a turbine case, wherein an interface between the turbine and the cylinder head is free of a gasket and a flange; and wherein the interface between the integrally formed turbine and cylinder head comprises a plurality of supporting elements supported by ribs extending from the cylinder head.

10. The turbocharged engine of claim 9, wherein the turbine is physically coupled to the cylinder head without fasteners, welds, fusions, and adhesives.

11. The turbocharged engine of claim 9, wherein the turbine case is free of coolant passages, and where the metal structure extends to a close-coupled emission control device, wherein there are no intervening components arranged between the turbine case and the close-coupled emission control device.

12. The turbocharged engine of claim 9, wherein the turbine case extends from a bearing housing to an exhaust outlet of the turbine.

13. The turbocharged engine of claim 9, wherein the metal structure is aluminum or an aluminum alloy comprising one or more of copper, silicon, manganese, and magnesium.

14. The turbocharged engine of claim 9, further comprising a polymer composite coating surfaces of the metal structure shaped to flow exhaust gases in the cylinder head and the turbine.

15. A system comprising:

a continuous metal structure shaped as a single-piece free of interruptions in its contour, the continuous metal structure shaping a turbine case integrally formed with a cylinder head, wherein the cylinder head comprises a plurality of exhaust passages merging to form a single exhaust passage extending outward from the cylinder head that turns in a downward direction into the turbine case;

wherein an interface between the cylinder head and the turbine case comprises a plurality of supporting elements supported by ribs that extend from the cylinder head toward the turbine case, and wherein the interface between the cylinder head and the turbine is free of a gasket and a flange.

16. The system of claim 15, wherein a width of an interface where the single exhaust passage meets the turbine case is equal to or less than a width of the single exhaust passage.

17. The system of claim 15, wherein the turbine case is free of passages for flowing liquids and gases other than an exhaust gas inlet and an exhaust gas outlet.

18. The system of claim 15, wherein the turbine case comprises cut-outs for a wastegate and an exhaust gas sensor, and where the turbine case comprises a depression shaped to accommodate a fastener.

19. The system of claim 15, wherein the plurality of exhaust passages, the single exhaust passage, an exhaust gas inlet of a turbine, a volute of the turbine, and an exhaust gas outlet of the turbine are coated with a polymer composite material configured to block heat transfer between exhaust gas and the continuous metal structure.

* * * * *